United States Patent [19]

DeHart et al.

[11] Patent Number: 4,645,414

[45] Date of Patent: Feb. 24, 1987

[54] COMBINED VACUUM PUMP, BEARING AND SEAL ASSEMBLY

[75] Inventors: Arnold O. DeHart, Rochester; James D. Symons, Southfield, both of Mich.

[73] Assignee: General Motors Corporation, Detroit, Mich.

[21] Appl. No.: 742,425

[22] Filed: Jun. 7, 1985

[51] Int. Cl.[4] ..... F04D 25/08

[52] U.S. Cl. ..... 415/83; 415/106; 415/170 R; 277/96.1

[58] Field of Search ..... 415/170 R, 172 R, 83, 415/90, 106; 384/112, 123, 134, 292, 369, 478; 277/96, 96.1, 3, 81 R

[56] References Cited

U.S. PATENT DOCUMENTS

| | | | |
|---|---|---|---|
| 3,109,658 | 11/1963 | Barrett et al. | 277/96 |
| 3,804,424 | 4/1974 | Gardner | 277/96.1 |
| 3,894,741 | 7/1975 | McHugh | 277/96.1 |
| 4,486,026 | 12/1984 | Furumura et al. | 277/96.1 |
| 4,523,764 | 6/1985 | Albers et al. | 277/96.1 |
| 4,543,037 | 9/1985 | Etsion | 415/90 |

*Primary Examiner*—Robert E. Garrett
*Assistant Examiner*—John Kwon
*Attorney, Agent, or Firm*—Patrick M. Griffin

[57] ABSTRACT

A combination vacuum pump, low friction bearing and seal assembly is provided in which a rotor relatively rotatable with respect to a stator has two sets of radially spaced, concentric spiral grooves. As the rotor rotates, one set of grooves forces sufficient ambient air between confronting surfaces of the rotor and stator to keep them axially spaced and provide a low friction bearing. Another set of grooves forces sufficient air from the vessel and through a one-way air exit to evacuate the vessel. A restriction created by the axially spaced confronting surfaces substantially prevents ambient air from moving radially inwardly to the evacuated vessel, as well as trapping the ambient air to maintain the axial spacing. Any ambient air passing through the restriction is dumped back to ambient through the same air exit, thereby keeping the evacuated vessel sealed.

3 Claims, 4 Drawing Figures

COMBINED VACUUM PUMP, BEARING AND SEAL ASSEMBLY

This invention relates to vacuum pumps generally and specifically to a combined vacuum pump, low friction bearing and seal assembly for evacuating and sealing a vessel or the like.

In an inertial energy storage device with high rotational speeds, such as a flywheel, operation in a vacuum is important to reduce frictional energy loss. The maintenance of a vacuum requires sealing to prevent the ingress of ambient air, and it is likewise important to reduce or prevent rubbing friction between relatively rotating parts. It is known, of course, to use a conventional vacuum pump with such a device. It is also known that an air bearing using spiral grooves can provide a very low friction bearing between rapidly rotating parts.

In the U.S. Pat. No. 4,470,752, to Teruo et al. a liquid fuel supply pump is shown that uses two relatively rotating cylinders, one contained within the other. The inner cylinder has several sets of oppositely directed shaft grooves, to force a liquid fuel in different axial directions within the annular space between the cylinders. For example, in the embodiment shown in FIG. 3, one set of grooves 14 forces liquid 17 in one axial direction while the other set of grooves 15 forces the liquid in an opposite axial direction toward a centrally located port 10. Thus, the pump acts much like a shaft and oil seal in which either the shaft or the seal itself has spiral grooves to continually force a film of oil toward the inside of the seal.

The pump disclosed in the above patent would be unsuitable for pumping air for several reasons. First of all, the clearance between the relatively rotating cylindrical surfaces is too large to act as an efficient air pump. Although the patent states that the clearance is small, and that the pumping action improves as the clearance is made smaller, the smallest clearance disclosed is approximately 5 micrometers, or approximately 200 microinches. That clearance is orders of magnitude larger than the clearance necessary to efficiently pump air, which would be on the order of 20 to 40 microinches. In addition, the liquid fuel pump is disclosed as operating at a maximum RPM of approximately 1,800, far lower than the rotational speed of the flywheel disclosed in the subject invention, 12,000 RPM. Even if the clearance were decreased to that necessary for an efficient air pump, at the higher rotational speeds used with the subject invention, there would be frictional heating of the inner cylinder. The resultant expansion of the inner cylinder relative to the outer cylinder would be likely to cause seizing of the pump. In addition, the structure in the above patent provides for unrestricted passage of the liquid fuel from both axial directions to the central port. No means is disclosed for preventing back flow, because there is no need to segregate the liquid fuel upstream from the port from that downstream. In evacuating a vessel, some means would be necessary to keep the upstream ambient air strictly segregated from the downstream evacuated vessel, in order to maintain the vacuum.

SUMMARY OF THE INVENTION

The subject invention provides a combined vacuum pump, low friction bearing and seal assembly that will operate to both evacuate a vessel and seal it against the ingress of ambient air.

The invention is disclosed for use with an energy storage flywheel that rotates at high speed within a vessel which it is desired to evacuate, in order to reduce frictional energy loss. A shaft joined to the flywheel is rotatable therewith about an axis in one direction and is used to rotate other structure of the invention.

A disk shaped rotor member is attached to the shaft and rotates therewith. A disk shaped stator member of similar diameter is supported so as to be non-rotatable relative to the vessel, as well as coaxial with and axially movable relative to the rotor member. The planar surfaces of the rotor and stator members are of substantially equal size and axially confront one another. An air inlet means is provided to allow passage of air from the vessel and between the confronting surfaces of the rotor and stator members.

The surface of the rotor member includes a first and a second pattern of shallow spiral grooves defined therein, which are concentric and defined about the axis of the shaft. The first, radially inner groove pattern is oriented so as to force air from the vessel, through the air inlet means, and radially outwardly between the confronting planar surfaces as the rotor member rotates with the shaft. The second, radially outer groove pattern is oriented oppositely to the first so as to simultaneously force air from the ambient and radially inwardly between the confronting surfaces as the shaft rotates. The first and second groove patterns terminate at an ungrooved annular portion of the rotor member surface, defining a radial space that separates the first and second groove patterns.

The surface of the stator member has a circular groove defined therein located in an area which is just radially inside of the ungrooved annular portion of the rotor member surface. The circular groove is also, therefore, located in an area on the opposite side of the radial space from the radially outer, second groove pattern. The circular groove communicates with a passage in the stator member that opens to the ambient through a one-way valve. Therefore, a one-way air exit means is provided that gives a low resistance passage for air to the ambient. In addition, a preload means consisting of coil springs biased between the vessel and the stator member keeps the confronting surfaces of the rotor and stator members biased axially toward one another.

At rest, the preload springs keep the axially confronting surfaces of the rotor and stator members in contact. As the rotor member begins to rotate, eventually reaching a desired predetermined speed, air will be forced radially inwardly from the ambient and between the confronting surfaces by the second groove pattern. Sufficient air will be drawn in from the ambient to space the confronting surfaces axially apart against the force of the preload springs. The axial spacing serves several functions. First of all, the axial spacing is sufficiently large to prevent direct contact between the rotor and stator members, thereby providing a low friction bearing. The axial spacing is also sufficiently small to allow the first groove pattern to force sufficient air out of the vessel, through the inlet means and to the ambient through the air exit means to substantially evacuate the vessel.

The axial spacing between the confronting surfaces also allows the ungrooved portion of the rotor surface that radially separates the first and second groove patterns, in cooperation with the surface of the stator, to provide a restriction with a high resistance to passage of ambient air. The ambient air drawn radially inwardly by the second groove pattern is thereby substantially trapped to maintain the axial spacing. Furthermore, any ambient air that does pass through the restriction will, because of the location of the circular groove, pass back to the ambient through the air exit means. Therefore, the air exit means also cooperates to keep the evacuated vessel sealed from the ambient. A combined vacuum pump, bearing and seal is thereby provided with a very simple structure.

It is, therefore, a broad object of the invention to provide a combined vacuum pump, low friction bearing and seal assembly for evacuating a vessel and sealing it against the ingress of ambient air.

It is another object of the invention to provide a vacuum pump of the type described in which first and second radially spaced groove patterns on the surface of a rotatable rotor member axially confront the surface of an axially movable stator member, with rotation of the rotor member allowing one of the groove patterns to force sufficient ambient air between the confronting surfaces in one radial direction to axially space the confronting surfaces apart sufficiently to provide a low friction bearing, an axial spacing that is small enough to allow the other groove pattern to force sufficient air from the vessel through an air inlet means, in the other radial direction, and out a one-way air exit means to evacuate the vessel, while the spaced confronting surfaces also cooperate to form a restriction to substantially trap the ambient air between the surfaces and maintain the axial spacing, with any ambient air passing through the restriction also exiting through the same air exit means, thereby also keeping the evacuated vessel sealed from the ambient.

It is a further object of the invention to provide a vacuum pump of the type described for evacuating a vessel within which an inertial energy storage device rotates, with the rotor member supported so as to rotate with the energy storage device at a predetermined speed of the energy storage device, and thereby provide a combined vacuum pump, low friction bearing and seal for the vessel to allow the energy storage device to rotate within the vessel with reduced frictional energy loss.

DESCRIPTION OF THE PREFERRED EMBODIMENTS

These and other objects and features of the subject invention will appear from the following written description and drawings in which;

FIG. 1 shows the invention partially in section and partially in elevation;

FIG. 2 is a sectional view taken along the line 2—2 of FIG. 1 with the relative position of check valve 70 and passage 66, which would not actually show, shown in phantom;

Figure 1:
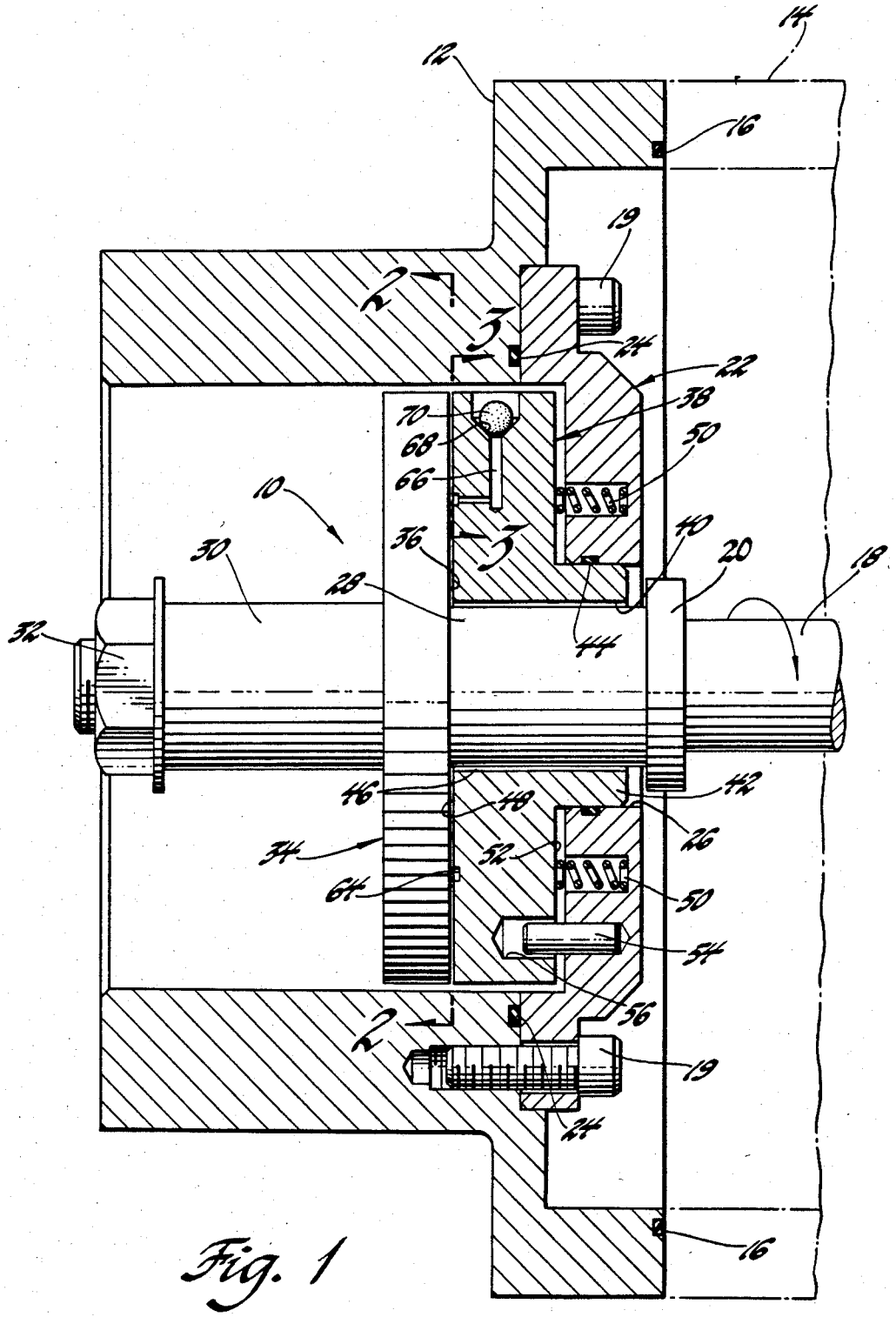

Referring first to FIG. 1, the invention, designated generally at 10, uses the rotational speed of an inertial energy storage device, a flywheel, to provide a combined vacuum pump, low friction bearing and seal assembly. The flywheel is conventional, and not illustrated. The invention 10 is located generally within a cylindrical skirt 12. Skirt 12 is sealed relative to a vessel 14, part of which is shown in dotted lines, by O-ring 16. The flywheel rotates within vessel 14 at a predetermined speed, which is approximately 12,000 RPM for the embodiment disclosed. The invention 10 evacuates and seals vessel 14 to allow the flywheel to operate with reduced frictional energy loss. It will be understood, however, that the invention may be applied wherever a vessel or the like is to be evacuated and sealed.

Still referring to FIG. 1, a shaft, designated generally at 18, is attached to the flywheel so as to rotate therewith. Shaft 18 would be maintained in axial and radial position relative to vessel 14 by the same structure that would support the flywheel, not shown. Attached to the interior of skirt 12 by bolts 19 is a stator base 22. Stator base 22 is sealed with respect to skirt 12 by another O-ring 24. Stator base 22 includes a central aperture 26 therethrough, coaxial with shaft 18, which serves a purpose described below. Cylindrical spacers 28 and 30 are seated between radial seat 20 and a nut and bolt assembly 32 respectively. Spacers 28 and 30 rigidly clamp a rotor member, designated generally at 34, to shaft 18 axially spaced from stator base 22. Rotor member 34 is a steel disk with a planar surface 36, best seen in FIG. 2. Rotor member 34 is supported on shaft 18 so as to rotate with the flywheel.

Referring again to FIG. 1, a stator member, designated generally at 38, is located between rotor member 34 and stator base 22. Stator member 38 is also a disk, made of carbon in the embodiment disclosed. Stator member 38 has a diameter equal to rotor member 34, and has a central aperture 40 therethrough which is slightly larger in diameter than cylindrical spacer 28. A cylindrical extension 42 of stator member 38 fits closely, but slidably, within the central aperture 26 in stator base 22. Another O-ring, 44, seals between cylindrical extension 42 and stator base 22. Therefore, the only inlet means provided for passage of air from vessel 14 is the narrow annular space 46 between cylindrical spacer 28 and central aperture 40. One side of stator member 38 includes a planar surface 48 that is substantially the same size as and axially confronts the planar surface 36 of rotor member 34. Four compression springs, two of which are visible at 50, are compressed between stator member 22 and the outer side 52 of stator member 38. Springs 50 act as a preload means to provide a continual bias of approximately 15 pounds. Since stator member 38 is axially movable relative to stator base 22, and rotor member 34 is rigid to the shaft 18, the respective planar surfaces 36 and 48 are maintained in contact with one another when rotor member 34 is at rest. A pin 54 fixed to the stator base 22 fits within a slot 56 in stator member 38 to prevent stator member 38 from rotating relative to vessel 14.

Figure 2:
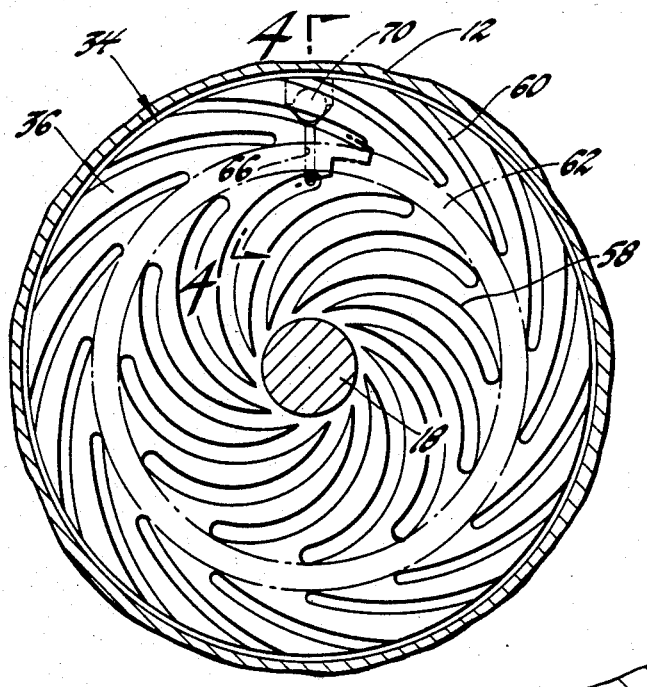

Referring next to FIG. 2, rotor member surface 36 includes a radially inner, first pattern of grooves 58 and a radially outer, second pattern of grooves 60. Groove patterns 58 and 60 are both formed in a spiral with a shallow depth of approximately twelve hundredths of a millimeter, by the same methods used in forming the spiral grooves of conventional air bearings. First and second groove patterns are shown both defined in rotor member surface 36, although one or both could be formed in stator member surface 48. First and second groove patterns 58 and 60 terminate at an ungrooved annular portion of rotor member surface 36, shown by dotted lines. The termination defines an annular radial space 62 that radially separates groove patterns 58 and 60. Regardless of which surface contains groove patterns 58 and 60, their termination will define such a radial space 62 separating them. It will be understood that, because of their opposite orientation, first and second groove patterns 58 and 60 have the capability to force air between the confronting surfaces 36 and 48 in opposite radial directions. Groove patterns 58 and 60 need not be exactly coplanar as disclosed. However, it is important that the ungrooved portion of rotor member surface coextensive with radial space 62 be coplanar with, or slightly above that part of surface 36 in which the groove pattern 58 and 60 are formed, as will be more fully explained below.

Figure 3:
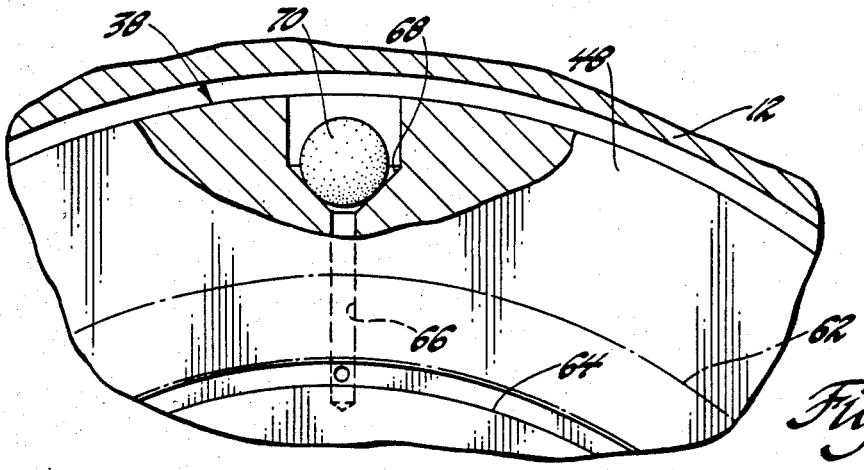
FIG. 3 is an enlarged sectional view taken along the line 3—3 of FIG. 1.

Referring next to FIGS. 1 and 3, stator member 38 includes a circular groove 64 cut into surface 48 and located just radially inside of the location of the annular ungrooved portion of rotor member surface 36. Thus, groove 64 is located in an area on the opposite side of radial space 62 from second groove pattern 60. At the top of stator member 38, a drilled passage 66 opens through a conical seat 68 to the ambient, with a ball valve 70 seated on conical seat 68. The structure just described, and its specific location, allows the operation of the invention 10 to be described next.

Figure 4:
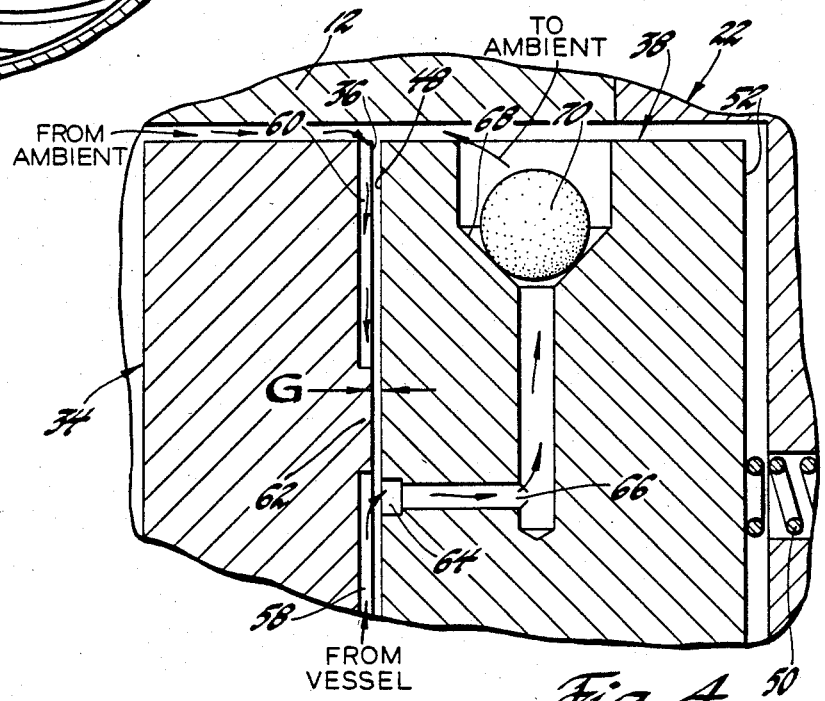
FIG. 4 is an enlarged view of a portion of FIG. 1, but with the rotor member 34 shown in section taken generally along the line 4—4 of FIG. 2.

Referring next to FIG. 4, the radial space 62 is shown as it would appear in a section of rotor member 34 taken through two grooves, one in each of the two groove patterns 58 and 60. It will be understood that every groove of both groove patterns 58 and 60 terminates at radial space 62.

Still referring to FIG. 4, the operation of invention 10 may be understood. FIG. 4 illustrates the relative location of confronting surfaces 36 and 48 during operation as the flywheel rotates at its predetermined speed. As shaft 18 begins to rotate from rest, air is forced from the ambient between surfaces 36 and 48 by second groove pattern 60 and moves radially inwardly toward radial space 62. Second groove pattern 60 forces sufficient ambient air between surfaces 36 and 48 to space them axially apart approximately 20 to 40 microinches against the force of the compression springs 50. Other structure best discussed below cooperates in maintaining that axial spacing. The axial spacing or gap, designated at G, is sufficiently large to prevent rubbing between rotor member 34 and stator member 38, and a low friction bearing is thereby provided. The spacing G can be maintained regardless of any thermal expansion of the confronting surfaces 36 and 48, since stator member 38 is axially movable relative to rotor member 34.

The axial spacing G is also sufficiently small that the first groove pattern 58 can operate as an efficient vacuum pump. As rotor member 34 rotates, first groove pattern 58 will force air from vessel 14, through annular space 46, and radially outwardly between confronting surfaces 36 and 48. Next, the air will spill into the circular groove 64, and then pass through drilled passage 66, past ball valve 70, and ultimately to the ambient. The weight of ball valve 70, and the force of atmospheric pressure, are sufficient to keep it seated on conical seat 68 and prevent the back flow of ambient air. A one-way air exit means is thereby provided. At the predetermined speed of 12,000 RPM for the embodiment disclosed, sufficient air is pumped to give a pressure depression of 99.38 kPa, and vessel 14 is thereby substantially evacuated.

The invention also provides a seal. The axial spacing G is sufficiently small that the confronting surfaces 36 and 48 cooperate to provide a restriction with a high resistance to the passage of ambient air through the radial space 62. The formation of this restriction is the reason that the ungrooved portion of rotor member surface 36 should be coplanar with, or above, the plane of the rest of surface 36 in which groove patterns 58 and 60 are formed. The restriction substantially traps the ambient air forced inwardly by the second groove pattern 60 to maintain the axial spacing G against the force of compression springs 50. Some ambient air may pass through the restriction. However, because of the location of circular groove 64, any ambient air that does pass the restriction to circular groove 64 will likewise be dumped to the ambient through ball valve 70. Therefore, the air exit means also cooperates with the restriction in keeping the evacuated vessel 14 sealed against the ingress of air from the ambient. The various air paths are all illustrated by arrows and labeled.

Therefore, it will be seen that a simple and effective combined vacuum pump, low friction bearing and seal for evacuating and maintaining a vacuum as been provided. The invention finds special utility when used in conjunction with a rotatable inertial energy storage device, such as a flywheel. It will be understood that the invention is capable of being embodied in structures other than that disclosed, and is not intended to be so limited.

The embodiments of the invention in which an exclusive property or privilege is claimed are defined as follows:

1. A combination vacuum pump, low friction bearing and seal assembly for evacuating a vessel or the like and sealing the vessel against ingress of ambient air during operation of the pump, comprising:

a rotor member supported for unidirectional rotation about an axis relative to said vessel to operate said pump, a stator member supported non-rotatably relative to said vessel and axially movable relative to said rotor member, said rotor and stator members further including axially confronting surfaces, air inlet means providing for passage of air from said vessel between said confronting surfaces, a first groove pattern defined about said axis in one of said confronting surfaces and oriented so as to force air from said vessel through said air inlet means in one radial direction when said rotor member is rotated in one direction, a second groove pattern defined in one of said confronting surfaces substantially concentric to the first groove pattern and oriented oppositely thereto so as to force air from the ambient between said confronting surfaces in the opposite radial direction when said rotor member is rotated in said one direction, said second groove pattern terminating radially of said first groove pattern so as to define a radial space therebetween, one-way air exit means providing for a low resistance passage of air to the ambient from an area located on the opposite side of said radial space from said second groove pattern, and, preload means acting to bias said rotor and stator members axially toward one another with a predetermined force, whereby, when said rotor member is rotated during operation of said pump at a predetermined speed in said one direction, sufficient air is forced from the ambient between said confronting surfaces by said second groove pattern to space said surfaces axially apart against said preload means a distance sufficiently large to prevent direct contact therebetween to provide a low friction bearing, said axial spacing also being sufficiently small to allow said first groove pattern to force sufficient air from said vessel through said inlet means and to the ambient through said air exit means to substantially evacuate said vessel, while said spaced confronting surfaces also cooperate to provide a restriction with a high resistance to the passage of ambient air through said radial space to said air exit means, thereby substantially trapping said ambient air drawn in by said second groove pattern to maintain said axial spacing, with any ambient air passing through said restriction passing back to the ambient through said air exit means which thereby also cooperates to keep said evacuated vessel sealed from the ambient.

2. A combination vacuum pump, low friction bearing and seal assembly for evacuating a vessel or the like and sealing the vessel against ingress of ambient air during operation of the pump, comprising:

a rotor member supported for unidirectional rotation about an axis relative to said vessel to operate said pump, a stator member supported non-rotatably relative to said vessel and axially movable relative to said rotor member, said rotor and stator members further including axially confronting surfaces, air inlet means providing for passage of air from said vessel between said confronting surfaces, a radially inner groove pattern defined about said axis in the surface of said rotor member and oriented so as to force air from said vessel through said air inlet means radially outwardly when said rotor member is rotated in one direction, a radially outer groove pattern defined in the surface of said rotor member substantially concentric to the radially inner groove pattern and oriented oppositely thereto so as to force air from the ambient radially inwardly between said confronting surfaces when said rotor member is rotated in said one direction, said groove patterns terminating radially of one another so as to leave a radial space therebetween, one-way air exit means in said stator member providing for a low resistance passage of air to the ambient from an area located radially inwardly of said radial space between said groove patterns, and, preload means acting to bias said rotor and stator members axially toward one another with a predetermined force, whereby, when said rotor member is rotated during operation of said pump at a predetermined speed in said one direction, sufficient air is forced radially inwardly from the ambient between said confronting surfaces by said radially outer groove pattern to space said surfaces axially apart against said preload means a distance sufficiently large to prevent direct contact therebetween to provide a low friction bearing, said axial spacing also being sufficiently small to allow said radially inner groove pattern to force sufficient air radially outwardly from said vessel through said inlet means and to the ambient through said air exit means to substantially evacuate said vessel, while said spaced confronting surfaces also cooperate to provide a restriction at said radial space with a high resistance to the passage of ambient air radially inwardly to said air exit means, thereby substantially trapping said ambient air drawn in by said radially outer groove pattern to maintain said axial spacing, with any ambient air passing radially inwardly through said restriction passing back to the ambient through said air exit means which thereby also cooperates to keep said evacuated vessel sealed from the ambient.

3. A combination vacuum pump, low friction bearing and seal assembly for evacuating and sealing from the ingress of ambient air a vessel or the like within which an inertial energy storage device rotates in one direction at a predetermined speed, comprising:

a rotor member supported so as to rotate with said energy storage device about an axis relative to said vessel to operate said pump, a stator member supported non-rotatably relative to said vessel and axially movable relative to said rotor member, said rotor and stator members further including axially confronting surfaces, air inlet means providing for passage of air from said vessel between said confronting surfaces, a first groove pattern defined about said axis in one of said confronting surfaces and oriented so as to force air from said vessel through said air inlet means in one radial direction when said rotor member rotates in said one direction, a second groove pattern defined in one of said confronting surfaces substantially concentric to the first groove pattern and oriented oppositely thereto so as to force air from the ambient between said confronting surfaces in the opposite radial direction when said rotor member rotates in said one direction, said second groove pattern terminating radially of said first groove pattern so as to define a radial space therebetween, one-way air exit means providing for a low resistance passage of air to the ambient from an area located on the opposite side of said radial space from said second groove pattern, and, preload means acting to bias said rotor and stator members axially toward one another with a predetermined force, whereby, when said rotor member rotates during operation of said pump at said predetermined speed in said one direction, sufficient air is forced from the ambient between said confronting surfaces by said second groove pattern to space said surfaces axially apart against said preload means a distance sufficiently large to prevent direct contact therebetween to provide a low friction bearing, said axial spacing also being sufficiently small to allow said first groove pattern to force sufficient air from said vessel through said inlet means and to the ambient through said air exit means to substantially evacuate said vessel, while said spaced confronting surfaces also cooperate to provide a restriction with a high resistance to the passage of ambient air through said radial space to said air exit means, thereby substantially trapping said ambient air drawn in by said second groove pattern to maintain said axial spacing, with any ambient air passing through said restriction passing back to the ambient through said air exit means which thereby also cooperates to keep said evacuated vessel sealed from the ambient to allow said energy storage device to rotate within said vessel with reduced frictional energy loss.

* * * * *